US010486873B2

(12) United States Patent
Gage

(10) Patent No.: US 10,486,873 B2
(45) Date of Patent: Nov. 26, 2019

(54) PALLET-LESS BRICK

(71) Applicant: Ball Corporation, Broomfield, CO (US)

(72) Inventor: Daniel Gage, Whitby (CA)

(73) Assignee: BALL CORPORATION, Broomfield, CO (US)

( * ) Notice: Subject to any disclaimer, the term of this patent is extended or adjusted under 35 U.S.C. 154(b) by 0 days.

(21) Appl. No.: 15/906,877

(22) Filed: Feb. 27, 2018

(65) Prior Publication Data

US 2018/0244449 A1 Aug. 30, 2018

Related U.S. Application Data

(60) Provisional application No. 62/464,013, filed on Feb. 27, 2017.

(51) Int. Cl.

| | |
|---|---|
| ***B29B 17/00*** | (2006.01) |
| ***B65D 71/00*** | (2006.01) |
| *B65D 85/46* | (2006.01) |

(52) U.S. Cl.

CPC ..... *B65D 71/0096* (2013.01); *B65D 71/0088* (2013.01); *B65D 85/46* (2013.01); *B65D 2571/00061* (2013.01); *B65D 2571/00086* (2013.01); *B65D 2571/00092* (2013.01)

(58) Field of Classification Search

CPC ..... E04B 2/08; E04B 2002/0215; E04B 2002/0206; E04B 2002/0204; A63H 33/08; B65D 71/0096; B65D 71/0088; B65D 85/46; B65D 2571/00061

USPC ..... 52/DIG. 9

See application file for complete search history.

(56) References Cited

U.S. PATENT DOCUMENTS

| | | | | |
|---|---|---|---|---|
| 650,919 A * | 6/1900 | Vordtriede | ..... | E04B 2/08 52/568 |
| 811,534 A * | 2/1906 | Akers et al. | ..... | E04B 2/18 52/286 |
| 1,339,596 A * | 5/1920 | Depatie | ..... | E04B 2/04 52/566 |
| 1,374,356 A * | 4/1921 | Clouser | ..... | E04B 2/08 52/562 |
| 3,272,158 A | 9/1966 | Barnum | | |

(Continued)

FOREIGN PATENT DOCUMENTS

| | | |
|---|---|---|
| EP | 2410102 | 7/2016 |

OTHER PUBLICATIONS

International Search Report and Written Opinion for International (PCT) Patent Application No. PCT/US18/19957, dated May 16, 2018 10 pages.

*Primary Examiner* — Gisele D Ford
(74) *Attorney, Agent, or Firm* — Sheridan Ross P.C.

(57) ABSTRACT

A pallet-less brick is provided that allows for materials to be transported without the use of straps or pallets, which makes the transportation and subsequent use of the materials more efficient and more environmentally friendly. The pallet-less brick can have a generally planar body with a series of protrusions and recesses extending in different directions. A protrusion extending in one direction can be received in a recess of an adjacent brick, such that the bricks are stackable without the use of straps or pallets. Similarly, a second protrusion and recess combination fulfill a similar function, and the multiple protrusions and recesses secure stacked pallets in at least two directions.

10 Claims, 8 Drawing Sheets

(56) References Cited

U.S. PATENT DOCUMENTS

| | | | | | |
|---|---|---|---|---|---|
| 3,611,952 | A | | 10/1971 | Hoffman | |
| 3,685,244 | A | * | 8/1972 | Palmer | E04C 1/40 52/591.4 |
| 3,709,160 | A | | 1/1973 | Howard | |
| 3,864,092 | A | * | 2/1975 | Ravitz | C22B 1/248 428/546 |
| 3,956,862 | A | * | 5/1976 | Alexandre, Jr. | E04B 2/22 52/286 |
| 4,614,071 | A | | 9/1986 | Sams et al. | |
| 4,651,485 | A | * | 3/1987 | Osborne | E04B 2/08 52/220.2 |
| 5,316,708 | A | | 5/1994 | Drews | |
| 5,365,714 | A | * | 11/1994 | Potvin | E04B 2/08 52/590.1 |
| 2004/0040245 | A1 | | 3/2004 | Sinclair et al. | |
| 2005/0144882 | A1 | * | 7/2005 | Chuang | E04B 2/16 52/596 |
| 2006/0260256 | A1 | * | 11/2006 | Everett | E04B 2/16 52/605 |
| 2009/0077920 | A1 | | 3/2009 | Korman et al. | |

* cited by examiner

PALLET-LESS BRICK

CROSS REFERENCE TO RELATED APPLICATION

This application claims priority under 35 U.S.C. § 119(e) to U.S. Provisional Patent Application Ser. No. 62/464,013 filed Feb. 27, 2017, which is incorporated herein in its entirety by reference.

FIELD OF THE INVENTION

The present invention relates generally to the transportation of aggregate metallic materials where the materials must be secured to prevent the accidental dislodgment of the materials.

BACKGROUND OF THE INVENTION

Currently, materials such as scrap metal need to be transported between different locations for manufacturing, processing, recycling, etc. For example, the initial location can be the primary source of the scrap metal. At a factory or manufacturing site, a metalworking process such as stamping or drawn and ironing for containers may result in scrap metal or excess material that is no longer necessary to create the finished product. This scrap metal can accumulate at the factory or manufacturing site. The scrap metal may subsequently need to be transported to a second site for several reasons. The company operating the factory or manufacturing site may seek to recoup material costs or use the scrap metal for another metalworking process. In addition, the company may seek to improve its sustainability by reducing waste. Regardless of the particular reason or reasons, the company needs to transport the scrap metal, or other material, to a second location, thus requiring trucks or rail and the inherent additional costs associated with the loading and transporting of the material.

Pallets are commonly utilized at industrial locations for transporting materials and components. Pallets provide a common surface for handling so that, for example, a forklift can pick up a pallet and load the pallet onto a truck. Without pallets, the forklift would have to load an engine, scrap metal, or other objects that have an irregular shape or are otherwise difficult to handle with the skids of a forklift. Straps can be utilized to secure the material to the pallet. Metal straps, tow straps, and other types of fasteners can secure an engine or other large piece of equipment to the pallet.

Straps may also be used to retain smaller materials such as metal scrap so that the metal scrap is secured to the pallet. In one example, scrap metal bricks weighing 20-30 lbs. each are created at the initial location. An overhead clamp can place six of these bricks together on a wooden pallet where the six bricks are secured together with straps. Additional layers can be added on top of the strapped-together bricks, and once assembled, the layers of scrap metal and pallets can be strapped together for a final securing of the materials. This aggregate or scrap material and the pallets can be loaded using a forklift or an overhead clamp and shipped to a second location for processing. The second location can be a recycling plant where the scrap metal is melted or reduced for future use.

One issue with current systems and methods for transporting materials is that the pallets and straps are different materials than the scrap materials that are being transported. As noted above, the pallets may be wooden and the straps may be synthetic tow straps. Therefore, when the materials, pallets, and straps arrive at the second location, the pallets and straps must be separated from the materials before the materials can be processed. This adds time and expense to the processing of the materials. Further, the straps may only be used once, and the pallets may quickly deteriorate after continuous use, which lessens the benefit of recycling or sustainability. There is also inherent instability when materials are strapped together on a pallet where the center of gravity can shift during transportation, which can cause the entire combination to fall or tip over and present inherent design risks. Further still, when collecting aggregate metallic material on a pallet, the top surface of the aggregate metallic material is uneven. As a result, stacking a flat bottom surface of a pallet onto another pallet of uneven aggregate metallic material becomes inherently difficult or impossible. Therefore, there is a need to improve the transportation of aggregate metallic materials and to remove the use of pallets and straps.

SUMMARY OF THE INVENTION

The above needs and other needs are addressed by the various embodiments and configurations of the present invention. This invention relates to a pallet-less brick that eliminates the use of pallets and straps during transportation of multiple bricks. As a result, the aggregate material or materials that make up the pallet-less brick can be transported more quickly and efficiently with less waste, making the pallet-less brick more environmentally friendly and economically beneficial.

It is an aspect of the present invention to provide a metallic brick from scrap material with a novel geometric profile with protrusions and recesses that allow multiple bricks to selectively engage each other without the use of straps or pallets. Alternatively, the brick could be made of other materials such as plastic, wood fiber, cardboard, shredded aluminum aggregate, textiles, paper, glass, etc., depending on the composition of the scrap material. In addition, it will be appreciated that materials in various embodiments of the present invention can be aggregated and compressed into bricks, melted and cast into bricks, etc.

A protrusion can extend above one surface of the brick and a corresponding recess can extend into the body of the brick on an opposing surface of the brick. Therefore, when bricks are stacked on top of each other, the protrusion of one brick selectively engages the recess of another brick. There can be a variety of protrusions and recesses in various embodiments of the present invention. A protrusion can extend across, or substantially across, a width or length of the brick and a corresponding recess extends into the body of the brick. The resulting protrusion-recess combination limits relative movement between two bricks in one direction. Another protrusion-recess combination extending in a different direction can limit relative movement in a further direction. The geometric profile of the pallet-less brick allows for the stacking of bricks in a safer manner as the bricks are less likely to dislodge or tip over.

It is another aspect of the present invention to provide a brick with one or more recesses that allow for the transportation and stacking of bricks. In lieu of pallets, recesses can be arranged on the brick to provide a common surface or area for a device or system such as a forklift to pick up the brick using skids. Therefore, in some embodiments, a pair of protrusions are offset from each other and extend above a top surface of the brick, and corresponding recesses extend into the body of the brick, and a forklift can engage the pair of offset recesses.

It is a further aspect of the present invention to provide a brick with protrusions and recesses having cross-sectional profiles that add further functionality and benefits to the brick and to systems of multiple stacked bricks. For example, the protrusions and recesses may taper as they extend above the brick and into the brick, respectively, to accommodate the misalignment of bricks during stacking. For instance, if a protrusion is misaligned as it selectively engages a recess, then the protrusion will contact a sloped edge of the recess. As the protrusion extends into the recess, the tapered shape of the recess guides the protrusion, and thus the two bricks, into alignment. Further still, a combination of a protrusion and recess can not only limit the relative movement between two bricks in one direction, but also the relative movement in a plurality of directions. For instance, a protrusion and recess may have a curved shape or an L-shape that allows the protrusion and recess combination to restrict the relative movement between two bricks in a plurality of directions. Additional features such as a barb, a detent, or a convex feature can correspond to an additional depression in the recess or simply create an interference fit with the recess. Accordingly, these types of features can limit the relative movement between bricks in a height dimension. It will be further appreciated that interference type fits are not the only type of interconnection or selective engagement between bricks. For instance, the protrusion may be a ball and the recess may be a socket so that there is limited relative movement, but also a degree of freedom, which in this example would be a rotational degree of freedom.

One particular embodiment of the present invention is a pallet-less brick for transporting aggregate materials, comprising a planar body extending in a first direction and a second direction; at least one protrusion extending from an upper surface of the planar body and extending in the first direction; and at least one recess extending into an opposing lower surface of the planar body and extending in the first direction, wherein the at least one recess is aligned with the at least one protrusion in the second direction, wherein the pallet-less brick is configured to selectively engage a second pallet-less brick in a stable manner.

In some embodiments, the first direction is perpendicular to the second direction. In various embodiments, the pallet-less brick further comprises a second protrusion extending from the upper surface of the planar body and extending in the second direction; and a second recess extending into the opposing lower surface of the planar body and extending in the second direction, wherein the second recess is aligned with the second protrusion in the first direction. In some embodiments, a cross-sectional area of a recess of the at least one recess taken along the second direction is larger than a cross-sectional area of the second recess taken along the first direction. In various embodiments, the second protrusion extends between two protrusions of the at least one protrusion in the second direction. In some embodiments, the second protrusion and the second recess are aligned with a center of the planar body in the first direction.

In various embodiments, the at least one protrusion extends above the planar body by a predetermined distance, and wherein the at least one recess extends into the planar body by the predetermined distance. In some embodiments, the at least one protrusion comprises two protrusions offset by an offset distance, and the at least one recess comprises two recesses offset by the offset distance. In various embodiments, the at least one protrusion tapers from a larger cross-sectional dimension to a smaller cross-sectional dimension as the at least one protrusion extends from the upper surface of the planar body, and the at least one recess tapers from a larger cross-sectional dimension to a smaller cross-sectional dimension as the at least one recess extends into the opposing lower surface of the planar body. In some embodiments, the pallet-less brick comprises at least one of a metal, a plastic, a wood fiber, a cardboard, a shredded aluminum aggregate, a textile, a paper, and a glass.

In some embodiments, the pallet-less brick further comprises at least one slot positioned in the opposing lower surface, wherein the at least one slot is adapted to receive a retaining device to secure a plurality of pallet-less bricks. In various embodiments, the pallet-less brick further comprises at least one further slot positioned in at least one of the upper surface of the pallet-less brick and a sidewall of the pallet-less brick, wherein the at least one further slot is adapted to receive a retaining device to secure a plurality of pallet-less bricks.

Another particular embodiment of the present invention is a method of forming a pallet-less brick, comprising (i) providing a formation device at a forming platform, the formation device having a first die and a second die, wherein the first die has a recess configured to form a protrusion, and the second die has a protrusion configured to form a recess; (ii) transporting scrap material to the formation device and the forming platform; (iii) accumulating a predetermined mass of the scrap material in the formation device; (iv) forming a pallet-less brick by compressing the scrap material between the dies of the formation device, wherein the pallet-less brick has a protrusion and a recess; and (v) transporting the pallet-less brick from the formation device and the forming platform, wherein the protrusion of the pallet-less brick is configured to selectively engage and nest in a recess of another pallet-less brick.

In various embodiments, the method further comprises (vi) providing a mass sensor of the formation device, wherein the mass sensor is configured to detect the predetermined mass of the scrap metal; and (vii) initiating the forming step upon detection, by the mass sensor, of the predetermined mass. In some embodiments, the method further comprises (viii) forming the protrusion on a first surface of a generally planar body of the pallet-less brick such that the protrusion extends along a first direction of the generally planar body; and (ix) forming the recess into a second surface of the generally planar body such that the recess extends along the first direction of the generally planar body, wherein the protrusion and the recess are aligned in a second direction that is substantially perpendicular to the first direction.

In some embodiments, the method further comprises (x) forming an additional protrusion on the first surface of the generally planar body such that the additional protrusion extends along the second direction of the generally planar body; and (xi) forming an additional recess into the second surface of the generally planar body such that the recess extends along the second direction of the generally planar body, wherein the additional protrusion and the additional recess are aligned in the first direction. In various embodiments, the method further comprises (xii) forming the protrusion on a first surface of a generally planar body of the pallet-less brick such that the protrusion extends above the first surface of the generally planar body by a predetermined distance; and (xiii) forming the recess into a second surface of the generally planar body such that the recess extends into the second surface of the planar body by the predetermined distance.

Yet another particular embodiment of the present invention is an apparatus for forming a pallet-less brick, comprising a staging platform configured to receive an aggregate formable material; a first forming die and a second forming die positioned proximate to the staging platform, wherein each of the first forming die and the second forming die have a predetermined geometric shape, and the predetermined geometric shapes of the forming dies are arranged in an opposing orientation; an actuator interconnected to at least one of the first forming die and the second forming die; and a control unit in operable communication with the actuator, wherein the control unit is configured to receive an input and then activate the actuator to drive the first forming die toward the second forming die, compress the aggregate formable material between the first forming die and the second forming die, and create a pallet-less brick.

In some embodiments, the apparatus further comprises a sensor configured to detect a predetermined mass of the aggregate formable material, wherein the sensor provides the input to the control unit when the sensor detects the predetermined mass. In various embodiments, the predetermined geometric shape of the first forming die comprises a recess configured to form a protrusion in the pallet-less brick, and the predetermined geometric shape of the second forming die comprises a protrusion configured to form a recess in the pallet-less brick. In some embodiments, the actuator is a hydraulic ram. In various embodiments, the actuator drives the first forming die away from the second forming die after one of a predetermined force generated by the actuator, a predetermined amount of time, and a predetermined distance traveled by at least a part of the actuator.

Another specific embodiment of the invention is a pallet-less brick for transporting materials, comprising a planar body extending in a first direction and a second direction; a first protrusion extending from a surface of the planar body and extending in the first direction; a first recess extending into an opposing surface of the planar body and extending in the first direction, wherein the first recess is aligned with the first protrusion in the second direction; a second protrusion extending from the surface of the planar body and extending in the second direction; and a second recess extending into the opposing surface of the planar body and extending in the second direction, wherein the second recess is aligned with the second protrusion in the first direction.

In some embodiments, the first direction is perpendicular to the second direction. In various embodiments, a cross-sectional area of the first recess taken along the second direction is larger than a cross-sectional area of the second recess taken along the first direction. In some embodiments, the first protrusion extends above the planar body in a height direction by a predetermined distance, and wherein the first recess extends into the planar body in the height direction by the predetermined distance. In some embodiments, the second protrusion extends between the first protrusion and the third protrusion in the second direction. In various embodiments, the first protrusion and the third protrusion are offset from a midline of the planar body by a midline offset such that the first protrusion and the third protrusion are symmetrically disposed about the midline in the second direction.

In various embodiments, the pallet-less brick further comprises a third protrusion extending from the surface of the planar body and extending in the first direction; a third recess extending into the opposing surface of the planar body and extending in the first direction, wherein the third recess is aligned with the third protrusion in the second direction; wherein the third protrusion is offset from the first protrusion by a predetermined distance, and the third recess is offset from the first recess by the predetermined distance.

A further specific embodiment of the present invention is a pallet-less brick for transporting materials, comprising a planar body extending in a first direction and a second direction, wherein the first direction is substantially perpendicular to the second direction; a first protrusion extending from a surface of the planar body and extending in the first direction; a first recess extending into an opposing surface of the planar body and extending in the first direction, wherein the first recess is aligned with the first protrusion in the second direction; a second protrusion extending from the surface of the planar body and extending in the first direction; and a second recess extending into the opposing surface of the planar body and extending in the first direction, wherein the second recess is aligned with the second protrusion in the second direction.

In various embodiments, the pallet-less brick further comprises a third protrusion extending from the surface of the planar body and extending in the second direction, wherein the third protrusion extends between the first protrusion and the second protrusion; and a third recess extending into the opposing surface of the planar body and extending in the second direction, wherein the third recess extends between the first recess and the second recess. In some embodiments, the first and second protrusions extend above the planar body in a height direction by a predetermined height, and the first and second recesses extend into the planar body in the height direction by the predetermined height; and wherein the third protrusion extends above the planar body in the height direction by a further predetermined height that is less than the predetermined height, and wherein the third recess extends into the planar body in the height direction by the further predetermined height. In some embodiments, the first protrusion tapers from a larger cross-sectional dimension to a smaller cross-sectional dimension as the first protrusion extends from the surface of the planar body. In various embodiments, a cross-sectional profile of the taper of the first protrusion varies in shape along the first direction.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements or components. Additional aspects of the present invention will become more readily apparent from the Detailed Description, particularly when taken together with the drawings.

The above-described embodiments, objectives, and configurations are neither complete nor exhaustive. As will be appreciated, other embodiments of the invention are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary of the Invention given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Figure 1C:
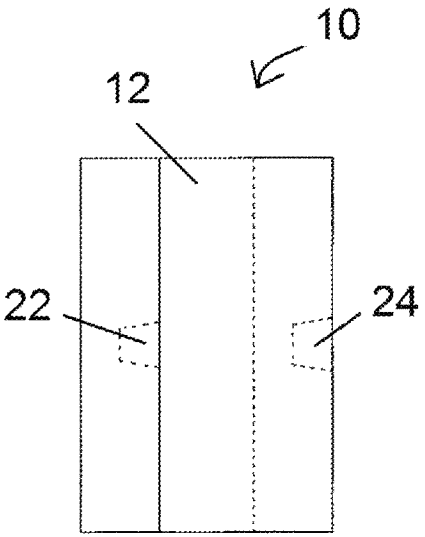
FIG. 1C is a right elevation view of the pallet-less brick in FIG. 1A in accordance with various embodiments of the present invention.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

A list of the various components shown in the drawings and associated numbering is provided herein:

| Number | Component |
|---|---|
| 10 | Brick |
| 12 | Body |
| 14 | First Direction |
| 16 | Second Direction |
| 18 | First Protrusion |
| 20 | First Recess |
| 22 | Second Protrusion |
| 24 | Second Recess |
| 26 | Third Protrusion |
| 28 | Third Recess |
| 30 | Body Length |
| 32 | Body Width |
| 34 | Body Height |
| 36 | Overall Height |
| 38 | Detent |
| 40 | Detent Recess |
| 42 | Conveyor |
| 44 | Lift Table |
| 46 | Formation Device |
| 48 | First Die |
| 50 | Second Die |
| 52 | Actuator |
| 54 | Control Unit |
| 56 | Sensor |
| 58 | Bailer |
| 60 | First Transporting Step |
| 62 | Accumulating Step |
| 64 | Forming Step |
| 66 | Second Transporting Step |
| 68 | Selectively Engaging Step |
| 70 | Securing Step |
| 72 | Slot |

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present invention are described herein and as depicted in the drawings. It is expressly understood that although the figures depict bricks and processes, methods, and systems for manufacturing the same, the present invention is not limited to these embodiments.

Figure 1A:
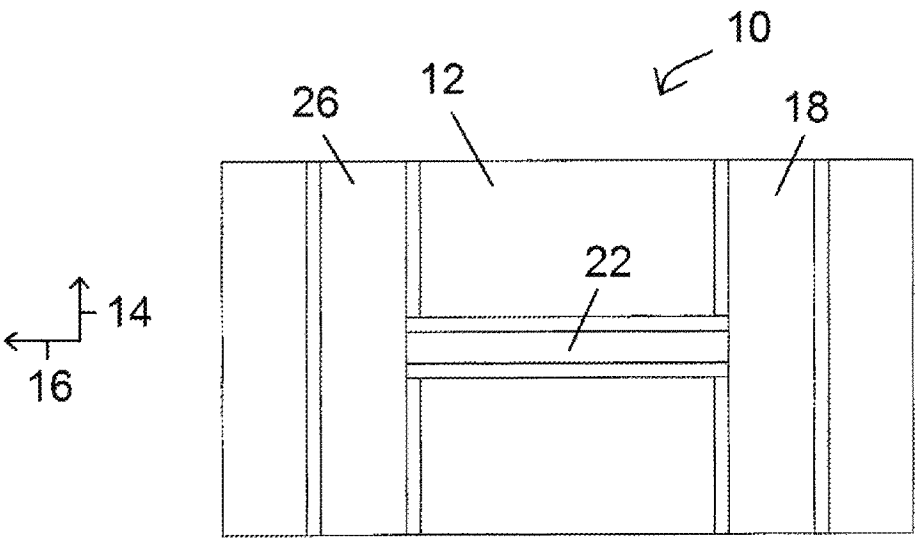
FIG. 1A is a top plan view of a pallet-less brick in accordance with various embodiments of the present invention.
Figure 1B:
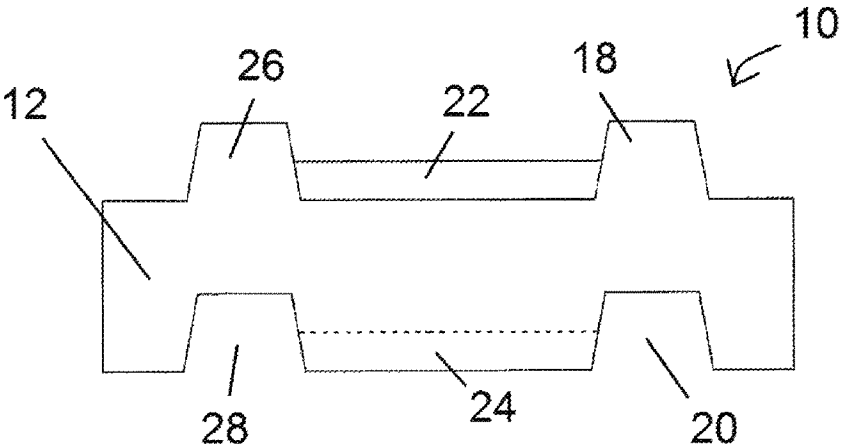
FIG. 1B is a front elevation view of the pallet-less brick in FIG. 1A in accordance with various embodiments of the present invention.

Referring to FIGS. 1A-1C, various views of a brick 10 are provided, including a top plan view of the brick 10 in FIG. 1A, a front elevation view of the brick 10 in FIG. 1B, and a right elevation view of the brick 10 in FIG. 1C. In these figures, the brick 10 has a generally planar body 12 that extends in a first direction 14 and a second direction 16, as shown in FIG. 1A. The brick 10 has a rectangular shape in these figures, but it will be appreciated that any shape can be utilized. In addition, any number of materials can be used to make the brick 10. For example, the brick 10 may be made from one or more of a metal, a plastic, a wood fiber, a cardboard, a shredded aluminum aggregate, a textile, a paper, and a glass.

The brick 10 has a series of protrusions and recesses that engage stacked bricks 10 to each other. A first protrusion 18 extends above a top surface of the planar body 12, and a first recess extends 20 into a lower surface of the planar body 12. As shown in FIG. 1A, the first protrusion 18 and first recess 20 extend in the first direction 14 across the width of the planar body 10. As shown in FIG. 1B, the first protrusion 18 and first recess 20 are aligned in the second direction 16. In other words, the first recess 20 extends into the planar body 12 below the first protrusion 18. With this particular arrangement, one brick 10 can stack on top of another brick 10, and the protrusion 18 of one brick 10 extends into, or selectively engages, the recess 20 of another brick 10. The selective engagement between the protrusion 18 and recess 20 prevents, or at least substantially diminishes, the relative movement between stacked bricks 10, specifically relative movement in the second direction 16.

FIGS. 1A-1C also show a second protrusion 22 and second recess 24 that serve a similar function as the first protrusion 18 and first recess 20. The second protrusion 22 extends above the top surface of the body 12 and extends in the second direction 16 but does not extend across the entire length of the body 12. Rather, the first protrusion 18 and a third protrusion 26 serve as the ends of the second protrusion 22. The second recess 24 extends into the body 12 of the brick 10 such that the second recess 24 receives a second protrusion 22 of another brick 10 in a stacked brick 10 configuration. The selective engagement between the second protrusion 22 and second recess 24 prevents, or at least substantially diminishes, the relative movement between stacked bricks 10, specifically relative movement in the first direction 14.

A third protrusion 26 and third recess 28 are offset from the first protrusion 18 and first recess 20 along length of the body 12 in the second direction 16. The third protrusion 26 and third recess 28 also function to prevent relative movement between stacked bricks 10 in the second direction 16. In addition, the combination of the first and third recesses 20, 28 allows for a system or vehicle such as a forklift to engage the brick 10 and move and orient the brick 10 from location to location, and/or to place the multiple bricks 10 into a stacked configuration.

The protrusions 18, 22, 26 and the recesses 20, 24, 28 have cross-sectionals shapes shown in FIGS. 1B and 1C that facilitate the stacking of bricks 10. The protrusions 18, 22, 26 taper as they extend above the top surface of the body 12, and the recesses 20, 24, 28 taper as they extend into the lower surface of the body 12. Thus, if there is a misalignment between two bricks 10 as the bricks 10 are stacked, the protrusions 18, 22, 26 contact a sloped edge of the respective recesses 20, 24, 28 and increasingly align as the two bricks selectively engage.

It will be appreciated that that the slope of the taper of the protrusions 18, 22, 26 and the respective recesses 20, 24, 28 can affect the performance of a stack of bricks 10. With zero taper, i.e., a square protrusion 18, 22, 26 and a square recess 20, 24, 28, a stack of bricks 10 will tolerate jostling in the lateral direction. However, the zero taper means that during assembly of the bricks 10, there is less room for misalignment. Conversely, with an aggressive taper, i.e., a shallow protrusion 18, 22, 26 and a shallow recess 20, 24, 28 a stack of bricks 10 will provide more room for misalignment but will provide less stability with respect to lateral jostling. It will be appreciated that embodiments of the present invention can include various tapers including zero taper depending on the requirements and/or limitations for assembling bricks 10 and then transporting bricks 10.

It will be appreciated that the cross-sectional shapes of the protrusions 18, 22, 26 and recesses 20, 24, 28 may be variable. The tapering cross-sectional shape may vary along the length of the protrusions 18, 22, 26 and recesses 20, 24, 28. For example, the tapering cross-sectional shape may comprise a part of the length of the protrusions 18, 22, 26 and recesses 20, 24, 28. Another length of the protrusions 18, 22, 26 may have cross-sectional shape with a convex feature that is received in a concave depression in the cross-sectional shape of the recesses 20, 24, 28. The convex feature-concave depression combination can secure, permanently or selectively, two bricks 10 together, which would prevent relative movement in the height dimension of the bricks 10. Further still, a part of the length of the protrusions 18, 22, 26 and recesses 20, 24, 28 could have zero taper and another part of the length of the protrusions 18, 22, 26 and recesses 20, 24, 28 could have taper such that the protrusions 18, 22, 26 and recesses 20, 24, 28 incur the benefits of both types of tapers.

Figure 2A:
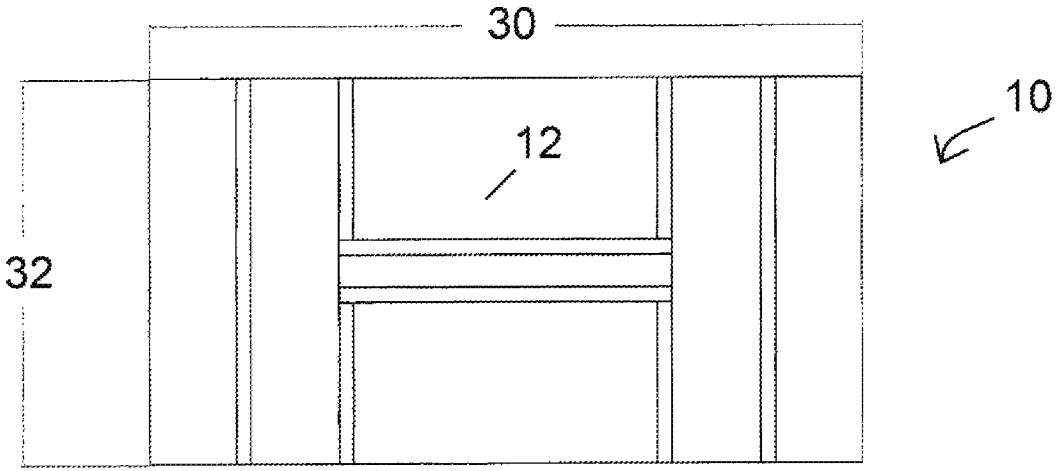
FIG. 2A is a top plan view of the pallet-less brick in FIG. 1A, showing particular dimensions in accordance with various embodiments of the present invention.
Figure 2B:
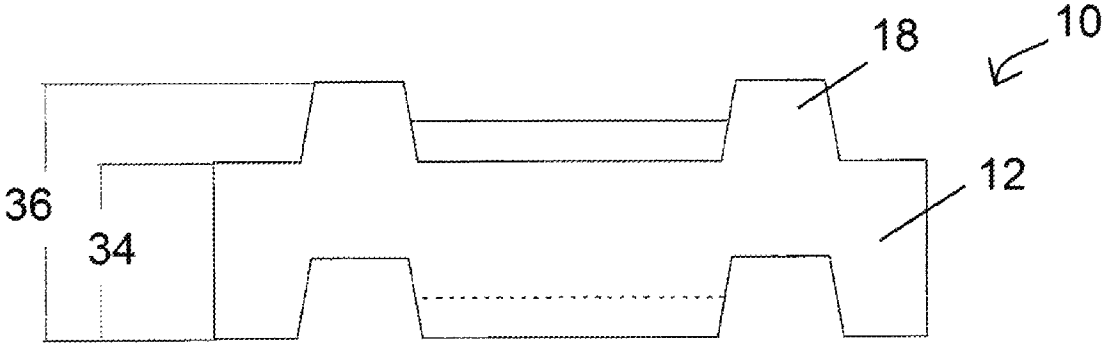
FIG. 2B is a front elevation view of the pallet-less brick in FIG. 1A, showing particular dimensions in accordance with various embodiments of the present invention.

Now referring to FIGS. 2A and 2B, a top plan view and a front elevation view of the brick 10 are provided, respectively, with specific dimensions. As shown in FIG. 2A, the length 30 of the brick 10 may be between approximately 36 and 52 inches in some embodiments. In various embodiments, the length 30 of the brick 10 may be approximately 44 inches. The width 32 of the brick 10 may be between approximately 16 and 32 inches in some embodiments. In various embodiments, the width 32 of the brick 10 may be approximately 24 inches.

As shown in FIG. 2B, the height 34 of the body 12 may be between approximately 7 and 15 inches in some embodiments. In various embodiments, the height 34 of the body 12 may be approximately 11 inches. The overall height 34 of the body 12 and the protrusion 18 may be between approximately 10 and 22 inches in some embodiments. In various embodiments, the overall height 34 of the body 12 and the protrusion 18 may be approximately 16 inches.

Figure 3A:
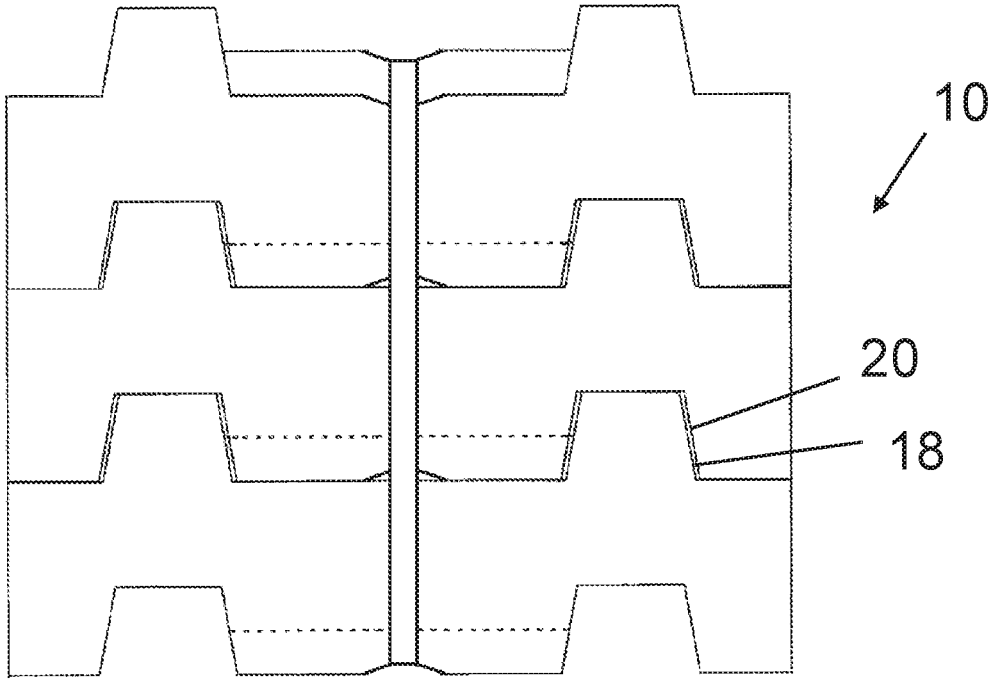
FIG. 3A is a front elevation view of selectively-engaged, pallet-less bricks having a trapezoidal protrusion-recess combination in accordance with various embodiments of the present invention.
Figure 3B:
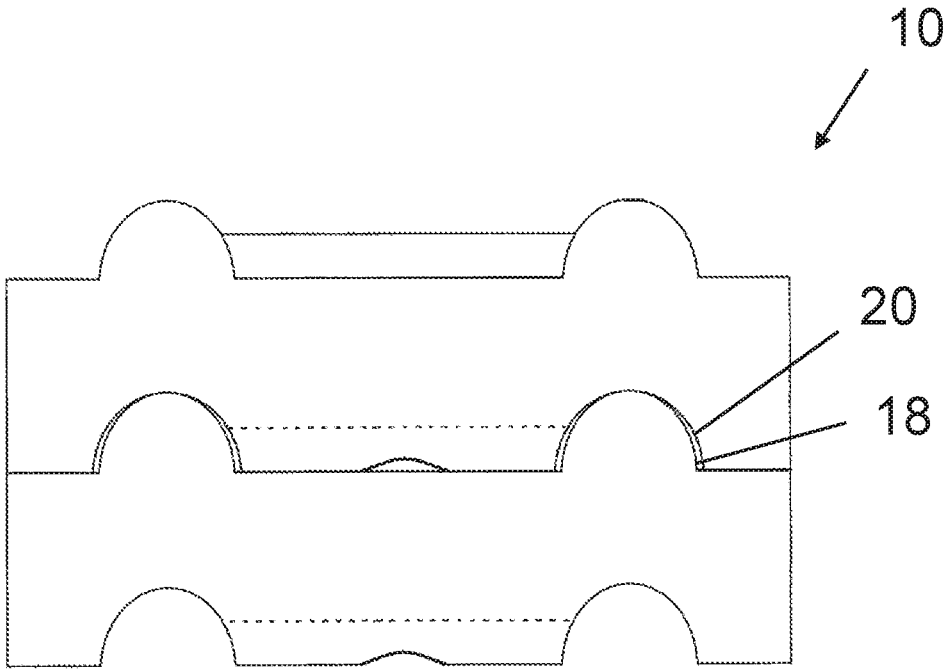
FIG. 3B is a front elevation view of selectively-engaged, pallet-less bricks having a circular protrusion-recess combination in accordance with various embodiments of the present invention.

Now referring to FIGS. 3A-3D, front elevation views of various combinations of pallet-less bricks 10 are provided. FIG. 3A depicts a two selectively engaged pallet-less bricks 10. The protrusion 18 of one brick and the recess 20 of another brick are interlocked to prevent relative motion between the bricks in at least one direction. As shown, a height of the protrusion 18 is approximately equal to a height, or depth, of the recess 20, and a width of the protrusion 18 is less than a width of the recess 20. This configuration can accommodate misalignment between the bricks during selective engagement. A strap is then located in one or more slots on the bricks 10 to secure the bricks 10 in a vertical dimension. It will be appreciated that in other embodiments, the widths of the protrusion 18 and the recess 20 may be approximately equal, or the width of the protrusion 18 may be larger than the width of the recess 20. In these embodiments, the selective engagement between bricks can include a deformation of one or more of the protrusion 18 and the recess 20 to provide a more secure engagement. FIG. 3B shows another embodiment of the present invention where the protrusion 18 and the recess 20 have a circular shape. The circular shape can accommodate misalignment between adjacent bricks.

Figure 3C:
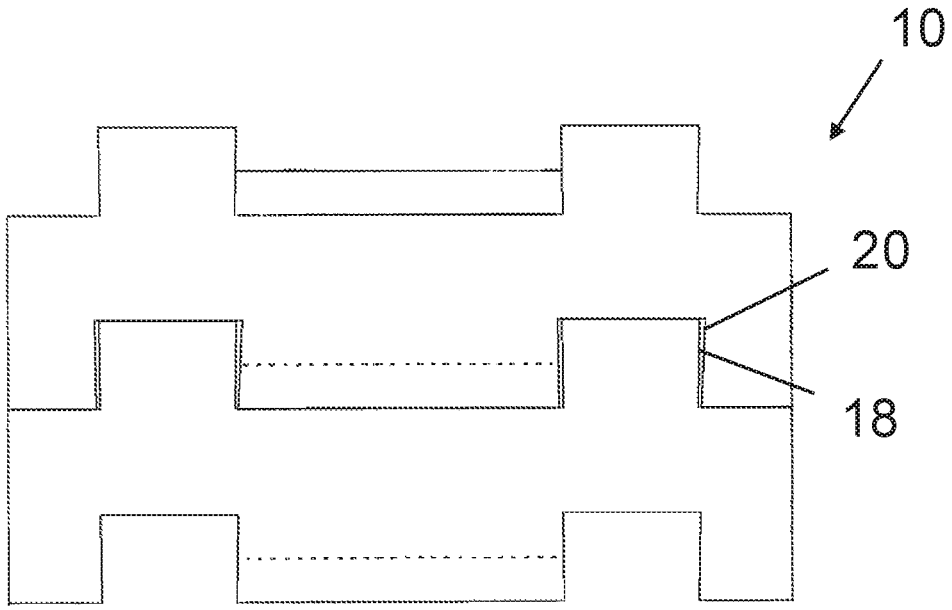
FIG. 3C is a front elevation view of selectively-engaged, pallet-less bricks having another trapezoidal protrusion-recess combination in accordance with various embodiments of the present invention.
Figure 3D:
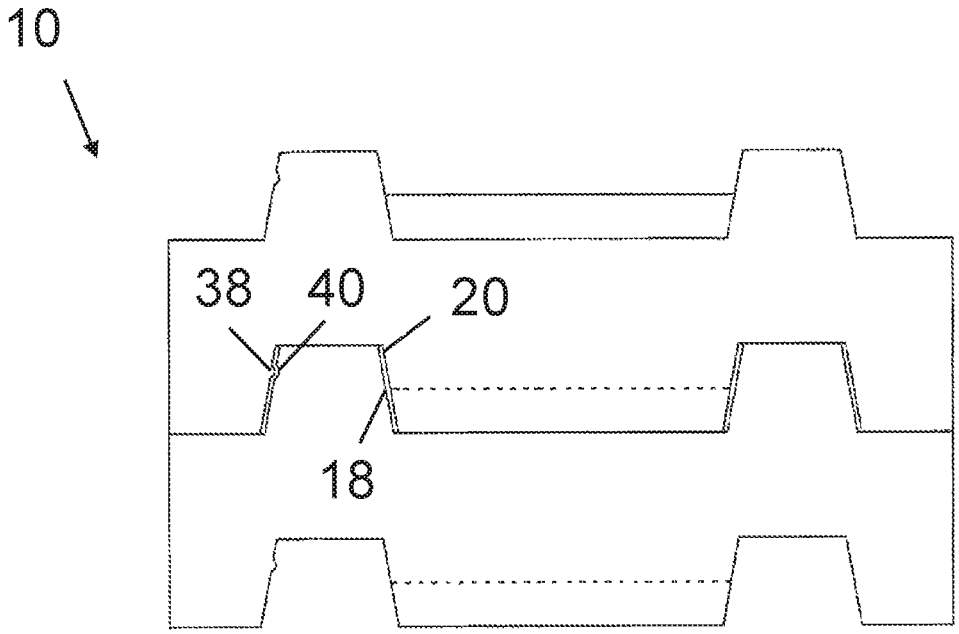
FIG. 3D is a front elevation view of selectively-engaged, pallet-less bricks having a trapezoidal protrusion-recess combination with a detent system in accordance with various embodiments of the present invention.

FIGS. 3C and 3D depict embodiments of selective engagement between pallet-less bricks that including deformable or deflectable components. The protrusion 18 of one brick in FIG. 3C is engaged with a recess 20 of another brick, and the protrusion 18 has a cross-sectional shape that tapers from a smaller dimension to a larger cross-sectional dimension as the protrusion 18 extends above a surface of the brick. Similarly, the recess 20 has a cross-sectional shape that tapers from a smaller cross-sectional dimension to a larger cross-sectional dimension as the recess 20 extends into a surface of the brick. With this configuration, the protrusion 18 deforms as the protrusion 18 passes the smallest dimension of the recess 20 during selectively engagement between the two bricks. Then, the deformed portion of the protrusion 18 at least partially rebounds. Thus, when the two bricks are completely engaged, a cross-sectional portion of the protrusion 18 is larger than a cross-sectional portion of the recess 20, and the two bricks are securely engaged to each other. It will be appreciated that in other embodiments of the invention, the recess 20 may have a constant cross-sectional dimension, area, or shape as the recess 20 extends into the brick.

Now referring to FIG. 3D, the recess 20 of one brick has a detent 38 and the protrusion 18 of another brick 18 has a detent recess 40. In this embodiment, the detent 38 extends into the recess 20 and is configured to contact a portion of the protrusion 18 during engagement of the bricks. The engagement proceeds past the interference between the detent 38 and the protrusion 18 until the detent 38 extends into a detent recess 40 in the protrusion 18. In this configuration, the engagement between bricks is secure in a lateral direction and a vertical or height direction. It will be appreciated that in some embodiments, the protrusion 18 may comprise the detent 38 and the recess 20 may comprise the detent recess 40. Further still, a given protrusion 18 or recess 20 may comprise a plurality of detents 38 or detent recesses 40.

Figure 4A:
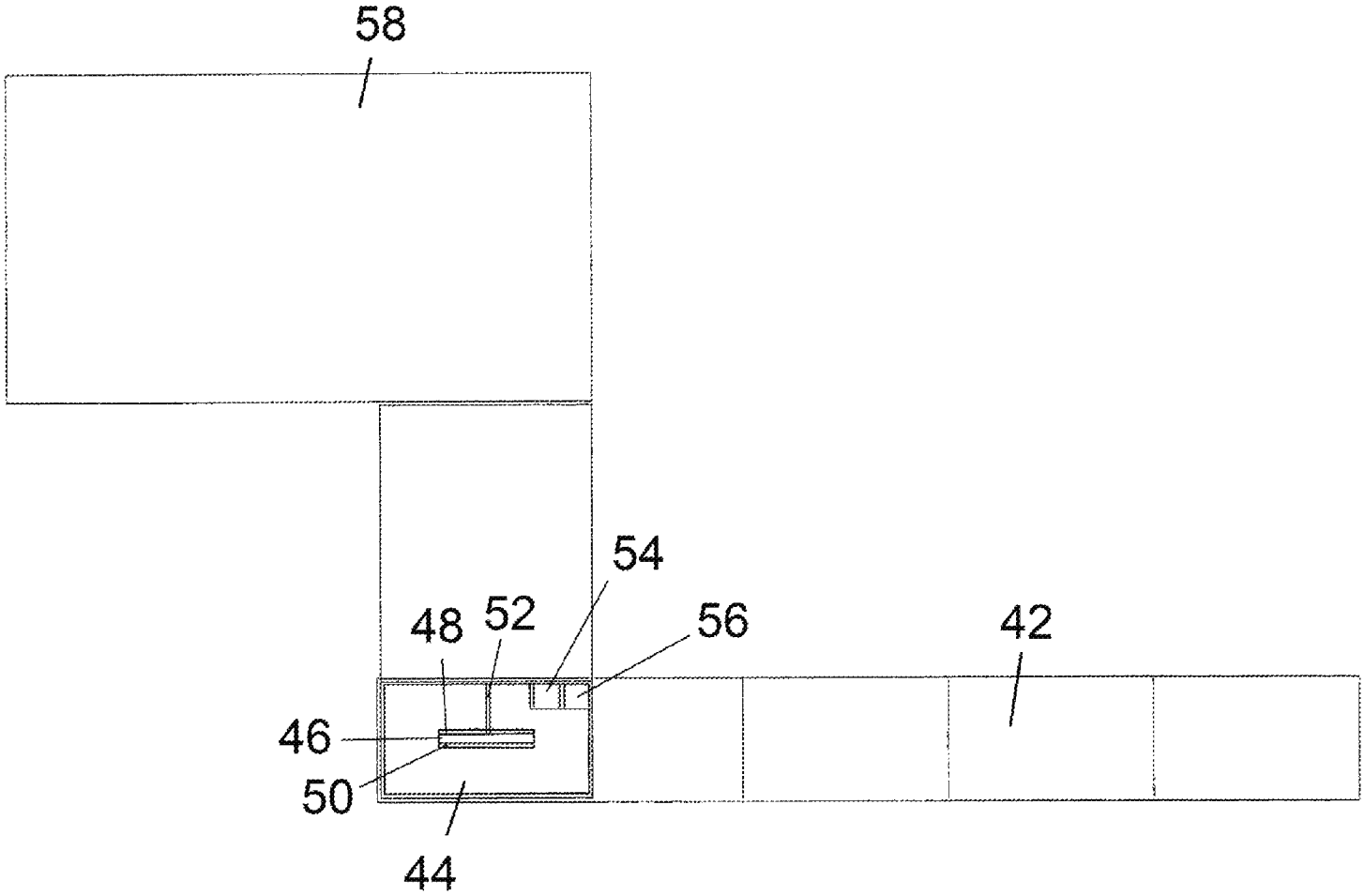
FIG. 4A is a top plan view of a system for manufacturing a pallet-less brick in accordance with various embodiments of the present invention.

Now referring to FIG. 4A, a top plan view of a system for manufacturing a pallet-less brick is provided. An aggregate material such as scrap metal or shredded aluminum is transported along a conveyor 38 to a lift table 40, which may in some circumstances be referred to as a forming platform or staging platform. The lift table 40 comprises a formation device 46 that has a first die 48 and a second die 50. It will be appreciated that other embodiments of the formation device 46 can include one die, more than two dies, a die and press combination, or any other components that can form aggregate material into a pallet-less brick. In this embodiment, the first die 48 has a face with a geometric shape oriented toward the center of the formation device 46, and the second die 50 has a face with a geometric shape oriented toward the center of the formation device 46. These geometric shapes are can be configured to produce the shape of pallet-less bricks described herein. For example, the first die 48 may have a recess configured to produce a protrusion on the pallet-less brick, and the second die 50 may have a protrusion configured to produce a recess on the pallet-less brick.

A power source is operably connected to at least one of the first die 48 and the second die 50 to form the pallet-less brick. In some embodiments, a first hydraulic ram is operably connected to the first die 48, and a second hydraulic ram is operably connected to the second die 50. In the depicted embodiment, a linear actuator 52 is operably connected to the first die 48. In response to an input, the linear actuator 52 has a component such as a piston rod that moves from a first position to a second position, which drives the first die 48 toward the second die 50. This movement compresses aggregate material that has accumulated in the formation device 46. The input can be a manual input directly to the linear actuator 52.

In the depicted embodiment, the lift table 44 and/or formation device 46 have a control unit 54 that controls different components of the lift table 44 and/or formation device 46, including providing the input to the actuator to form the pallet-less brick. The control unit 54 is operably connected to the actuator 52 and to a mass sensor 56, which is configured to detect a mass of accumulated aggregate material in the formation device 46. When the mass sensor 56 detects a predetermined mass of aggregate material, the mass sensor 56 can transmit an input to the control unit 54, which relays the input to the actuator 52 to activate the actuator 52, compress the dies 48, 50, and form the pallet-less brick.

It will be appreciated that the control unit 54 can have a computer-readable medium that is configured to perform at least some of the steps described herein. For instance, the computer-readable medium may be configured to direct different features and components to perform the functions and methods described with respect to FIGS. 4A and 4B. Further still, the control unit 54 may comprise, or be in operable connection with, a display unit that is configured to receive an input or inputs. In various embodiments, an operator can configure various parameters of the system and/or method through the display unit and control unit 54. The parameters can include one or more of the size or shape of the brick, the mass or weight of the brick, the compressive force applied to the dies and the accumulated scrap material, etc.

After the pallet-less brick is formed between the two dies 48, 50 of the formation device 46, the actuator 52 retracts to the first or initial position. The control unit 54 can initiate the retraction after a predetermined force is applied by the actuator 52, after a predetermined amount of time, and/or after the actuator 52, or part of the actuator 52, has extended by a predetermined distance. Then, the pallet-less brick is removed from the formation device 46 and transported to a bailer 58. The brick can be removed by an ejector device that pushes or rotates the brick out of the formation device 46 and a second conveyor can transport the brick away from the formation device 46. The bailer 58 can stack multiple bricks together and can optionally add straps to pluralities of bricks to secure the bricks together. After the bailer 58, the bricks can be transported, incurring the benefits described herein.

Figure 4B:
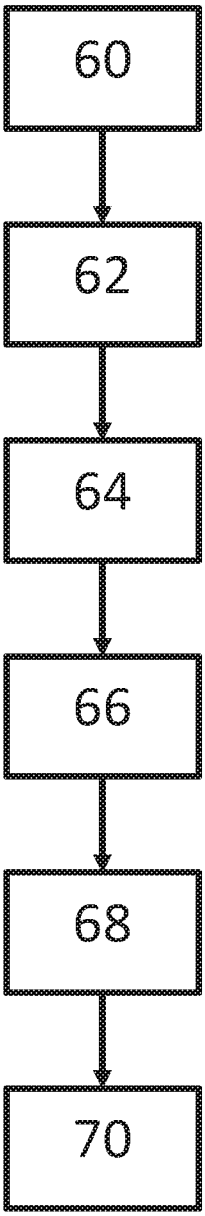
FIG. 4B is a flow chart depicting a method for manufacturing a pallet-less brick in accordance with various embodiments of the present invention.

Now referring to FIG. 4B, an exemplary method of manufacturing a pallet-less brick is provided. First, the aggregate material is transported 60 to a lift table that has a formation device, and the aggregate material is accumulated 62 in the formation device. Then, the formation device compresses and forms 64 the aggregate material into a pallet-less brick with a particular geometric profile. The pallet-less brick is transported 66 away from the formation device and lift table where multiple pallet-less bricks are selectively engaged 68 to one another to secure 70 a stack of pallet-less bricks.

Other methods and systems of manufacturing may produce the geometric profiles described herein. For example, an aggregate material may be melted down and then cast into ingots or bricks that have a particular geometric profile as described herein. Thus, the system for manufacturing a pallet-less brick can include a furnace for melting the aggregate material into a liquid state and a mold instead of dies for receiving the liquid aggregate material. The mold can include protrusions for forming recesses and recesses for forming protrusions in the finished product. Once in the mold, the aggregate material then freezes to a solid state, and the resulting brick can be stacked as described herein.

Figure 5A:
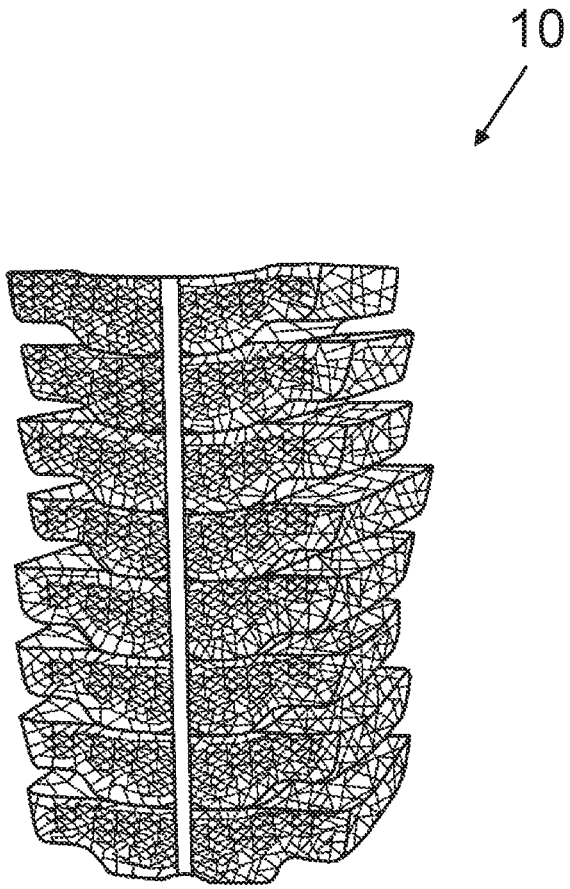
FIG. 5A is a perspective view of a storage configuration of pallet-less bricks in accordance with various embodiments of the present invention.

Now referring to FIG. 5A, a perspective view of stored bricks is provided. In this storage configuration, the bricks are stacked without additional straps. As explained herein, a given brick can selectively engage a brick below and/or a brick above.

Figure 5B:
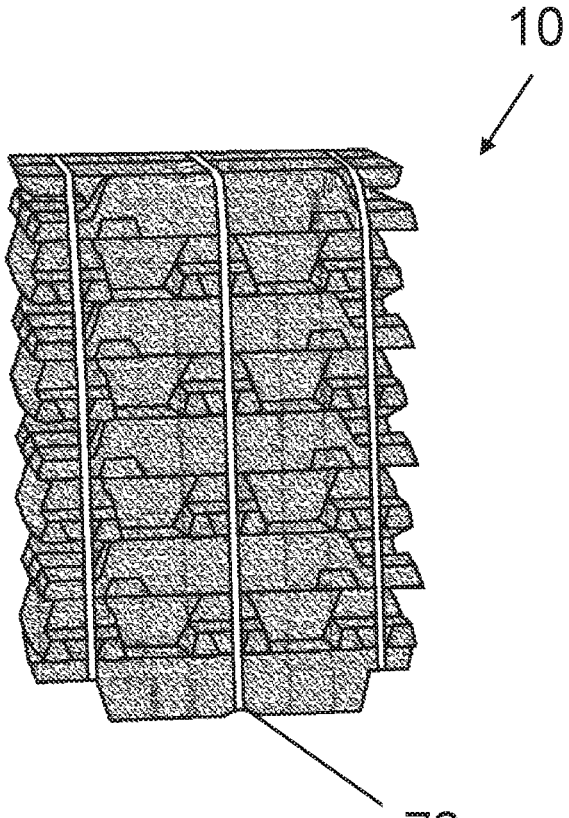
FIG. 5B is a perspective view of another storage configuration of pallet-less bricks in accordance with various embodiments of the present invention.

Now referring to FIG. 5B, a perspective view of stored bricks is provided where the bricks are secured with one or more straps. In this particular embodiment, the bricks are stacked and then strapped together to ensure that the selective engagement between bricks remains engaged. The four-brick combination may be approximately 42" high in some embodiments. While only four bricks are strapped together in FIG. 5B, it will be appreciated that more or less than four bricks can be combined in other embodiments of the invention.

In addition, the pallet-less brick may have a feature or features that position a retaining device with respect to the pallet-less brick. In some embodiments, one or more slots 72 may be positioned in a surface or surfaces of the brick. For example, a slot 72 on a lower surface of the pallet-less brick can have a width that is equal to or greater than a width of a retaining device such that the retaining device is positionable in the slot 72. Therefore, when multiple bricks are stacked together, the lower-most brick has a slot 72 exposed that can receive the retaining device and keep the retaining device aligned in at least one of a first lateral direction and a second lateral direction of the brick. Similarly, an upper surface and/or a sidewall of the brick can comprise a corresponding slot such that the retaining device is also positioned in a slot on the upper surface and/or the sidewall to secure multiple bricks together.

It will be appreciated that the slots can serve other functions beyond positioning a retaining device. For instance, two slots in the lower surface of the brick can be spaced apart from each other such that skids of a forklift or other transporting device can engage the slots to move the brick. After an initial positioning, a retaining device can be placed in the slots to secure multiple bricks together. A forklift can also transport a plurality of bricks that have been secured with one or more retaining devices.

In some embodiments of the invention, the pallet-less brick can have two sets of one or more slots. A first slot can extend along the lower surface of the pallet-less brick in a first direction to maintain a first retaining device in a second direction, and a second slot can extend along the lower surface of the pallet-less brick in the second direction to maintain a second retaining device in the first direction. Thus, the first and second slots intersect. There may also be a pair of first slots and a pair of second slots such that a forklift can engage the pallet-less brick from either lateral side. However, retaining device may be, but is not limited to, a synthetic tow strap, any type of strap, a rope, a plastic band, a metal band, etc. The retaining device may also include a tightening mechanism such as a ratchet that progressively reduces the dimension of a loop formed by the retaining device and maintains the final dimension of the loop to secure a plurality of bricks together. It will be appreciated that use of the term "recesses" may be interchangeable with use of the term "slots," or vice versa, in some embodiments. For instance, a pair of recesses on a lower surface of a pallet-less brick can be spaced apart to receive the skids of a forklift and/or one or more retaining devices as described herein with respect to a slot. Further still, it will be appreciated that the term "slot" may refer to an aperture that extends through the brick such that a pin or bar can be inserted into the brick for transporting one or more bricks. As with slots and recesses described herein, the apertures may be configured in different numbers and in different orientations.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. A pallet-less brick for transporting compressed metal scrap, comprising:

a body having a planar upper surface extending in a first direction and a second direction, wherein said first direction is substantially perpendicular to said second direction;

a planar first end and a planar second end positioned on opposing ends of said body, each of said planar first end and planar second end being void of any protrusions or recesses;

a first protrusion and a second protrusion extending upwardly from said upper surface of said body;

a first recess and a second recess extending inwardly into an opposing lower surface of said body, wherein said first recess is aligned directly below said first protrusion, and said second recess is aligned directly below said second protrusion;

a third protrusion extending upwardly from said upper surface of said body and extending between said first protrusion and said second protrusion; and a third recess extending inwardly into said opposing lower surface of said body and extending between said first recess and said second recess, and wherein said third recess is aligned directly below said third protrusion, wherein said body, said first protrusion, said second protrusion, and said third protrusion are made from scrap metal, and wherein said pallet-less brick is configured to selectively engage and nest with a second pallet-less brick in to allow a plurality of pallet-less bricks to be stacked in a vertical direction.

2. The pallet-less brick of claim 1, wherein a cross-sectional area of said first recess is larger than a cross-sectional area of said third recess.

3. The pallet-less brick of claim 1, wherein said third protrusion and said third recess are aligned with a center of said body.

4. The pallet-less brick of claim 1, wherein said first protrusion and said second protrusion extend above said body by a predetermined distance, and wherein said first recess and said second recess extend into said body by approximately the same predetermined distance.

5. The pallet-less brick of claim 1, further comprising at least one slot positioned in said opposing lower surface, wherein said at least one slot is adapted to receive a retaining device to secure a plurality of pallet-less bricks stacked in a vertical direction.

6. The pallet-less brick of claim 5, further comprising:

at least one further slot positioned in at least one of said upper surface of said pallet-less brick and a sidewall of said pallet-less brick, wherein said at least one further slot is adapted to receive a retaining device to secure a plurality of pallet-less bricks stacked in a vertical direction.

7. The pallet-less brick of claim 1, wherein said metal scrap is at least one of aluminum and aluminum alloy.

8. The pallet-less brick of claim 1, wherein said first and second protrusions taper at a predetermined angle as said first and second protrusions extend from said upper surface of said body.

9. The pallet-less brick of claim 1, wherein said first and second protrusions extend between opposing ends of said body.

10. The pallet-less brick of claim 1, wherein one end of said third protrusion terminates at said first protrusion, and another end of said third protrusion terminates at said second protrusion.

* * * * *